US007796933B2

(12) United States Patent
Ueno et al.

(10) Patent No.: US 7,796,933 B2
(45) Date of Patent: Sep. 14, 2010

(54) FIXING DEVICE USING ELECTROMAGNETIC INDUCTION HEATING AND IMAGE FORMING APPARATUS INCLUDING SAME

(75) Inventors: Satoshi Ueno, Kawasaki (JP); Kenji Ishii, Kawasaki (JP); Tadashi Ogawa, Machida (JP); Akiko Ito, Machida (JP); Hiroshi Seo, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/076,696

(22) Filed: Mar. 21, 2008

(65) Prior Publication Data

US 2008/0232873 A1 Sep. 25, 2008

(30) Foreign Application Priority Data

Mar. 23, 2007 (JP) ..... 2007-077017

(51) Int. Cl.
*G03G 15/20* (2006.01)

(52) U.S. Cl. ..... 399/333

(58) Field of Classification Search ..... 399/330, 399/333

See application file for complete search history.

(56) References Cited

U.S. PATENT DOCUMENTS

2004/0105708 A1* 6/2004 Imai et al. ..... 399/330
2006/0216079 A1* 9/2006 Nanjo ..... 399/333
2008/0063445 A1* 3/2008 Imai et al. ..... 399/333

FOREIGN PATENT DOCUMENTS

JP 2975435 9/1999
JP 2001-013805 1/2001

OTHER PUBLICATIONS

Abstract of JP 04-264479 published on Sep. 21, 1992.

* cited by examiner

*Primary Examiner*—David M Gray
*Assistant Examiner*—Billy J Lactaoen
(74) *Attorney, Agent, or Firm*—Harness, Dickey & Pierce, P.L.C.

(57) ABSTRACT

An image forming apparatus includes a fixing device to fix a toner image on a recording medium by applying heat. Such a fixing device includes at least a magnetic flux generator, a heat generating roller, a magnetic shunt layer, and a protective layer. The magnetic flux generator is configured to generate magnetic flux. The heat generating roller including a heat generating layer is configured to generate heat by the magnetic flux. The magnetic shunt layer may be formed independently of the heat generating layer. The protective layer is provided on an inner surface of the magnetic shunt layer and configured to cover a crack formed in the magnetic shunt layer during fabrication of the magnetic shunt layer. An image is fixed onto the recording medium by the heat from the heat generating roller. Alternatively, the magnetic shunt layer may be integrally provided with the heat generating layer.

16 Claims, 4 Drawing Sheets

FIXING DEVICE USING ELECTROMAGNETIC INDUCTION HEATING AND IMAGE FORMING APPARATUS INCLUDING SAME

CROSS-REFERENCE TO RELATED APPLICATION

This patent application is based on and claims priority pursuant to 35 U.S.C. §119 from Japanese Patent Application No. JP2007-077017, filed on Mar. 23, 2007 in the Japan Patent Office, the entire contents of which is hereby incorporated herein by reference.

BACKGROUND OF THE INVENTION

1. Field of the Invention

Exemplary aspects of the present invention generally relate to a fixing device and an image forming apparatus including the same, and more particularly, to a fixing device using electromagnetic induction heating as a fixing method and an image forming apparatus including the same.

2. Description of the Background Art

Image forming apparatuses such as copiers, printers, facsimile machines, and multi-function machines output an image by transferring a visible image, such as a toner image borne on an image carrier, onto a recording medium, for example, a recording medium such as a sheet of paper or the like.

When the toner image passes through a fixing device, toner is fused and permeated by heat and pressure to fix the toner image onto the recording sheet.

Heating methods implemented by such a fixing device include, for example, a heat roller fixing method and a film fixing method. In the heat roller fixing method, a heat roller as a heating member having a heat generating source, for example, a halogen lamp, is disposed across from a pressure roller. The heat roller and the pressure roller are in contact with each other, thereby forming a fixing nip. In the film fixing method, a film having less heat capacity than the roller is used as a heating member.

However, as disclosed in Japanese Patent Laid-Open Application Publication 2001-13805, for example, a fixing method using an electromagnetic induction heating method has drawn attention in recent years.

In the fixing method using the electromagnetic induction heating method disclosed in Japanese Patent Laid-Open Application Publication No. 2001-13805, an induction heating coil wound around a bobbin is provided inside the heat roller. When the induction heating coil is supplied with an electric current, an eddy current is generated in the heat roller, causing the heat roller to generate heat.

Such a structure is advantageous in that a temperature of the heat roller can immediately rise to a predetermined temperature without the need to heat up as is required in the heat roller fixing method.

In the fixing method using electromagnetic induction heating, the following fixing device as disclosed in Japanese Patent Number 2975435, for example, is known. Specifically, the fixing device includes a high-frequency induction heating device and a heat-generating layer. The high-frequency induction heating device includes an induction heating coil to which a high-frequency voltage is applied by a high-frequency power source. The heat-generating layer, which is magnetic, is provided to the heat roller.

A Curie point of the heat-generating layer is set approximately to a fixing temperature. When the high-frequency induction heating device is supplied with the high-frequency voltage by the high-frequency power source, the heat-generating layer generates heat.

In such a fixing device, the high-frequency induction heating device causes the temperature of a ferromagnetic material included in an adhesive to immediately rise to the Curie point. Upon reaching the Curie point the ferromagnetic material loses its magnetism and thereafter its temperature does not rise, enabling a constant temperature to be maintained.

Since the Curie point of the ferromagnetic material is set approximately to the fixing temperature, the temperature of the ferromagnetic material is maintained at the fixing temperature. Therefore, a reduction of a start-up time of the heat roller can be attained without deterioration in separation ability (releasability) and heat resistance of the surface of the heat roller, which are required of the fixing device, and without a complicated control device. Furthermore, high-precision temperature control can be achieved.

Among heat rollers having different thicknesses and shapes of a metal core or a resin release layer thereof, the heat capacity differs as well. However, by adjusting amounts of the ferromagnetic powder material, both start-up time and temperature control precision can be improved.

Furthermore, since the ferromagnetic powder material loses its magnetism at the Curie point, toner including the magnetic powder is attracted to the heat roller, thereby preventing an offset phenomenon or the like.

In the fixing device including the magnetic heat-generating layer, the Curie point of which is set approximately to the fixing temperature, frequently a material used in a magnetic shunt layer or a layer consisting integrally of the magnetic shunt layer and the heat generating layer is highly brittle, causing cracks in the brittle layer. Such cracking is undesirable because it disrupts temperature uniformity. Consequently, there is a possibility that image formation is adversely affected.

SUMMARY OF THE INVENTION

In view of the foregoing, exemplary embodiments of the present invention provide a fixing device capable of reducing, if not preventing entirely, cracks in a magnetic shunt layer and/or a layer formed integrally of the magnetic shunt layer and a heat generating layer, and an image forming apparatus including the fixing device.

In one exemplary embodiment, a fixing device for fixing a toner image on a recording Tedium by applying heat may include a magnetic flux generator, a heat generating roller, a magnetic shunt layer, and a protective layer. The magnetic flux generator is configured to generate magnetic flux. The heat generating roller includes a heat generating layer configured to generate heat by the magnetic flux. The magnetic shunt layer is formed independently of the heat generating layer. The protective layer is provided on an inner surface of the magnetic shunt layer and configured to cover a crack in the magnetic shunt layer formed during fabrication thereof. An image is fixed onto the recording medium by the heat from the heat generating roller.

Another exemplary embodiment provides a fixing device for fixing a toner image on a recording medium. The fixing device may include a magnetic flux generator, a heat generating roller, a magnetic shunt layer, and a protective layer. The magnetic flux generator is configured to generate magnetic flux. The heat generating roller includes a heat generating layer configured to generate heat by the magnetic flux. The magnetic shunt layer is integrally formed with the heat generating layer. The protective layer is provided on an inner surface of the magnetic shunt layer and configured to cover a crack formed in the magnetic shunt layer during fabrication of the magnetic shunt layer. An image is fixed onto the recording medium by the heat from the heat generating roller.

Yet another exemplary embodiment provides an image forming apparatus that includes at least a photoreceptor, a charging device, a developing unit, and a fixing device. The photoreceptor is configured to bear a latent image on a surface thereof. The charging device including a charging roller is configured to charge the photoreceptor. The developing unit including a developing roller is configured to develop the latent image with toner so as to produce a toner image. The fixing device is configured to fix the toner image on the recording medium by applying heat and may include a heat generating roller, a magnetic shunt layer, and a protective layer. The heat generating roller includes a heat generating layer configured to generate heat by magnetic flux. The magnetic shunt layer is provided independently of the heat generating layer. The protective layer is provided on an inner surface of the magnetic shunt layer and configured to cover a crack formed in the magnetic shunt layer during fabrication of the magnetic shunt layer. An image is fixed onto a recording medium by the heat from the heat generating roller.

Additional features and advantages of the present invention will be more fully apparent from the following detailed description of exemplary embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1:
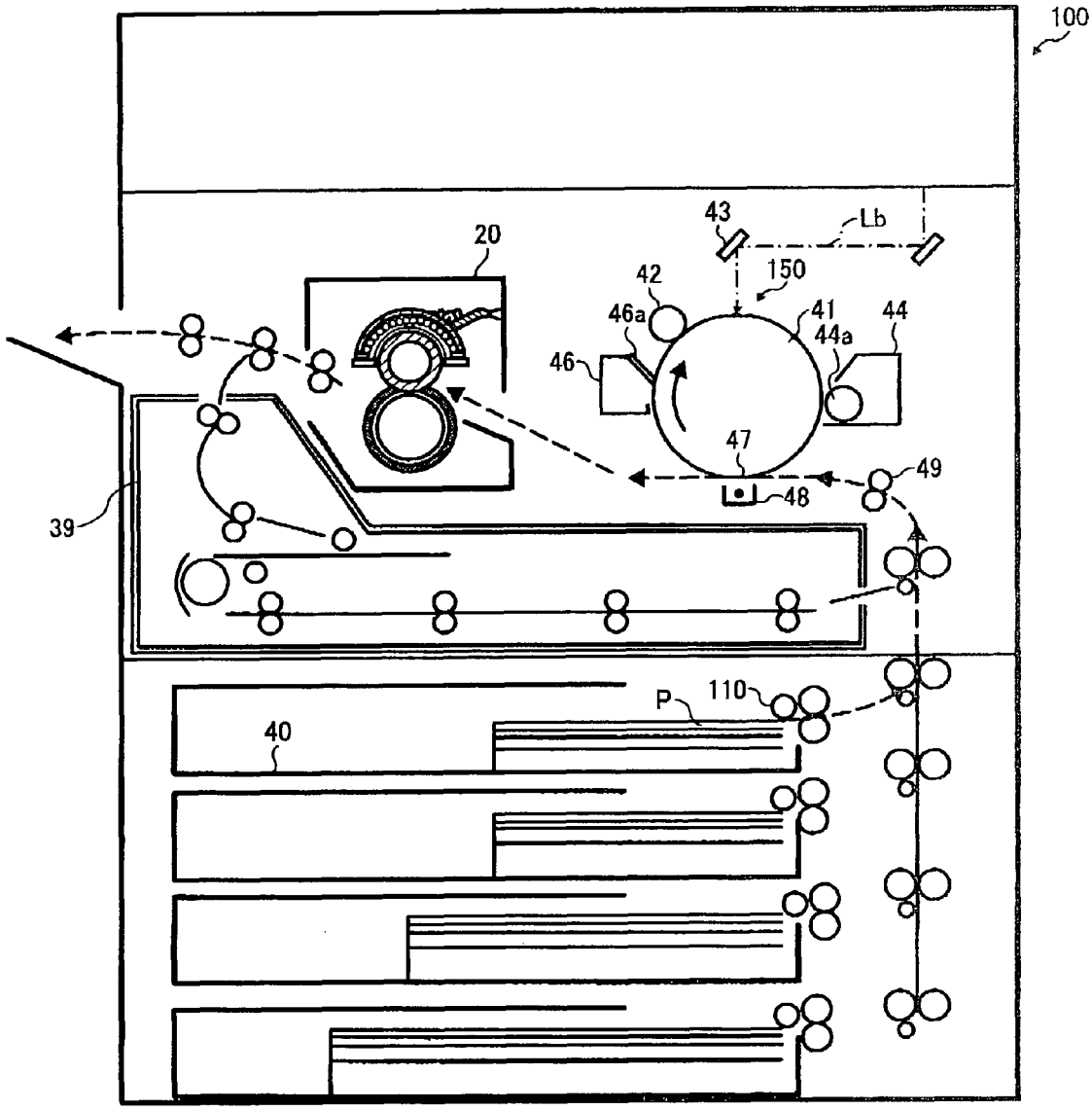
FIG. 1 is a schematic diagram illustrating an exemplary structure of an image forming apparatus, according to an exemplary embodiment of the present invention.

Exemplary embodiments of the present invention are now described below with reference to the accompanying drawings.

It will be understood that if an element or layer is referred to as being "on," "against," "connected to" or "coupled to" another element or layer, then it can be directly on, against connected or coupled to the other element or layer, or intervening elements or layers may be present.

In contrast, if an element is referred to as being "directly on," "directly connected to" or "directly coupled to" another element or layer, then there are no intervening elements or layers present. Like numbers refer to like elements throughout figures. As used herein, the term "and/or" includes any and all combinations of one or more of the associated listed items.

Spatially relative terms, such as "beneath," "below," "lower," "above," "upper" and the like, may be used herein for ease of description to describe an element or an element's feature or relationship to another element(s) or feature(s) as illustrated in the figures.

It will be understood that the spatially relative terms are intended to encompass different orientations of the device in use or operation in addition to the orientation depicted in the figures.

For example, if the device in the figures is turned over, elements described as "below" or "beneath" other elements or features would then be oriented "above" the other elements or features. Thus, the term such as "below" can encompass both an orientation of above and below.

The device may be otherwise oriented at various angles (i.e. rotated 90 degrees or at other orientations), and the spatially relative descriptors used herein are interpreted accordingly;

Although the terms first, second, etc. may be used herein to describe various elements, components, regions, layers and/or sections, it should be understood that these elements, components, regions, layers and/or sections should not be limited by these terms.

These terms are used only to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a," "an" and "the" are intended to include the plural forms as well, unless the context clearly indicates otherwise.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof. In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

In a later-described comparative example, exemplary embodiment, and alternative example, for the sake of simplicity of drawings and descriptions, the same reference numerals will be given to constituent elements such as parts and materials having the same functions, and redundant descriptions thereof will be omitted unless otherwise stated.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially to FIG. 1, one example of an image forming apparatus including a fixing device according to an exemplary embodiment of the present invention is described.

First Exemplary Embodiment

The image forming apparatus according to the exemplary embodiments is not limited to an image forming apparatus shown in FIG. 1. The image forming apparatus may be of a monochrome-type image forming apparatus producing a monochrome image, or of a full-color type image forming apparatus producing a color image.

FIG. 1 is a schematic diagram illustrating one exemplary structure of an image forming apparatus 100 according to an exemplary embodiment of the present invention.

The image forming apparatus 100 of FIG. 1 includes at least an electrophotographic photoreceptor 41 (hereinafter referred to as a photoreceptor), a charger 42, a mirror 43, a developing unit 44, a transfer unit 48, a cleaning unit 46 and so forth.

The photoreceptor 41 shown in FIG. 1 is an example of an image bearing member and is a rotary member having a drum shape. Surrounding the photoreceptor 41 there are provided: the charger 42 including a charging roller; the mirror 43 serving as one part of an exposure mechanism; the developing unit 44 including a developing roller 44*a*; the transfer unit 48 which transfers a developed image (a toner image) onto a recording medium P such as a transfer sheet and a sheet-type recording medium; and the cleaning unit 46 including a blade 46*a* which contacts the peripheral surface of the photoreceptor 41 in a sliding manner.

The photoreceptor 41 is irradiated with and exposed by an exposure light Lb at a position between the charger 42 and the developing roller 44*a* through the mirror 43. The position where the photoreceptor 41 is irradiated by the exposure light Lb is referred to as an exposure portion 150.

A transfer portion 47, which is known art, is provided at a position where the transfer unit 48 faces a bottom surface of the photoreceptor 41. The toner image is transferred to the recording medium P at the transfer portion 47.

A pair of registration rollers 49 is provided at a position further upstream than the transfer portion 47 in a sheet feed direction. The recording medium P, for example, the sheet-type transfer sheet stored in one of sheet feed trays 40, is fed by a group of sheet feed rollers 110 to the registration rollers 49.

Subsequently, the recording medium is guided and transported by a transportation guide and conveyance rollers, not shown.

At a position further downstream than the transfer portion 47 is provided a fixing device 20. Further downstream of the fixing device 20 is provided an automatic duplex printing unit 39.

When the duplex recording is performed, the automatic duplex printing unit 39 is configured to turn the recording medium P (transfer sheet) upside down such that the surface thereof having completed recording thereon faces down. The automatic duplex printing unit 39 re-feeds the recording medium P to the transfer portion 47.

Next, a description will be given of the image forming process of the image forming apparatus 100 according to the exemplary embodiments.

At an upper side of the image forming apparatus 100, first, the photoreceptor 41 starts to rotate. The photoreceptor 41 is evenly charged by the charger 42 in the dark while the photoreceptor 41 rotates.

The exposure portion 150 is irradiated by and scanned with the exposure light Lb corresponding to an image to be produced. Accordingly, a latent image corresponding to the image to produce is formed on the photoreceptor 41.

When the latent image approaches the developing unit 44 in accordance with the rotary movement of the photoreceptor 41, the latent image is developed into a visible image with toner, thereby forming a toner image. The toner image is then borne on the photoreceptor 41.

At a bottom portion of the image forming apparatus 100, the sheet feed rollers 110 of one of the plurality of the sheet feed cassettes 40 retrieve the recording medium P from the appropriate sheet feed cassette 40. The recording medium P is transported to the pair of the registration rollers 49 by way of a predetermined conveyance path in a manner indicated by a dotted line in FIG. 1. Subsequently, the recording medium P is temporarily stopped.

The recording medium P thus reaching the registration rollers 49 is then sent to the transfer portion 47 when the toner image formed on the photoreceptor 41 comes to a predetermined position of the recording medium P in the transfer portion 47. In other words, the recording medium P temporarily stopped at the registration rollers 49 is sent to the transfer portion 47 in appropriate timing such that the recording medium P is aligned with the toner image formed on the photoreceptor 41.

At the transfer portion 47, the position of the recording medium P where the toner image is to be transferred is aligned with the toner image formed on the photoreceptor 41. An electric field of the transfer unit 48 causes the toner particles constituting the toner image to be attracted to the recording medium P, thus transferring the toner image onto the recording medium P.

Subsequently, the recording medium P onto which the toner image is transferred at the image forming portion around the photoreceptor 41 is sent to the fixing device 20. While the toner image on the recording medium P passes the fixing device 20, heat and pressure are applied to the recording medium P by the fixing device 20 and the toner image is fixed onto the recording medium P. After the toner image is fixed on the recording medium P, the recording medium P is discharged onto a sheet discharge unit.

In the event that the image is formed on both sides of the recording medium P, the recording medium P is discharged to the automatic duplex printing unit 39 by a separation claw, not shown. In the automatic duplex printing unit 39, the recording medium P is reversed and transported to a conveyance path before the registration rollers 49.

Toner not having been transferred in the transfer unit 47 and remaining on the photoreceptor 41 (hereinafter referred to as residual toner) reaches the cleaning unit 46 as the photoreceptor 41 rotates. The residual toner is cleaned and eliminated from the photoreceptor 41 when passing the cleaning unit 46, thereby making it possible to advance to a next image formation.

The fixing device 20 according to the exemplary embodiments implements a fixing method using a pair of rollers. The fixing device 20 according to the exemplary embodiments is equipped with a heat source for heating a fixing roller, and a pressure roller for pressing the fixing roller against the recording medium. The detailed description thereof will be provided later.

Figure 2:
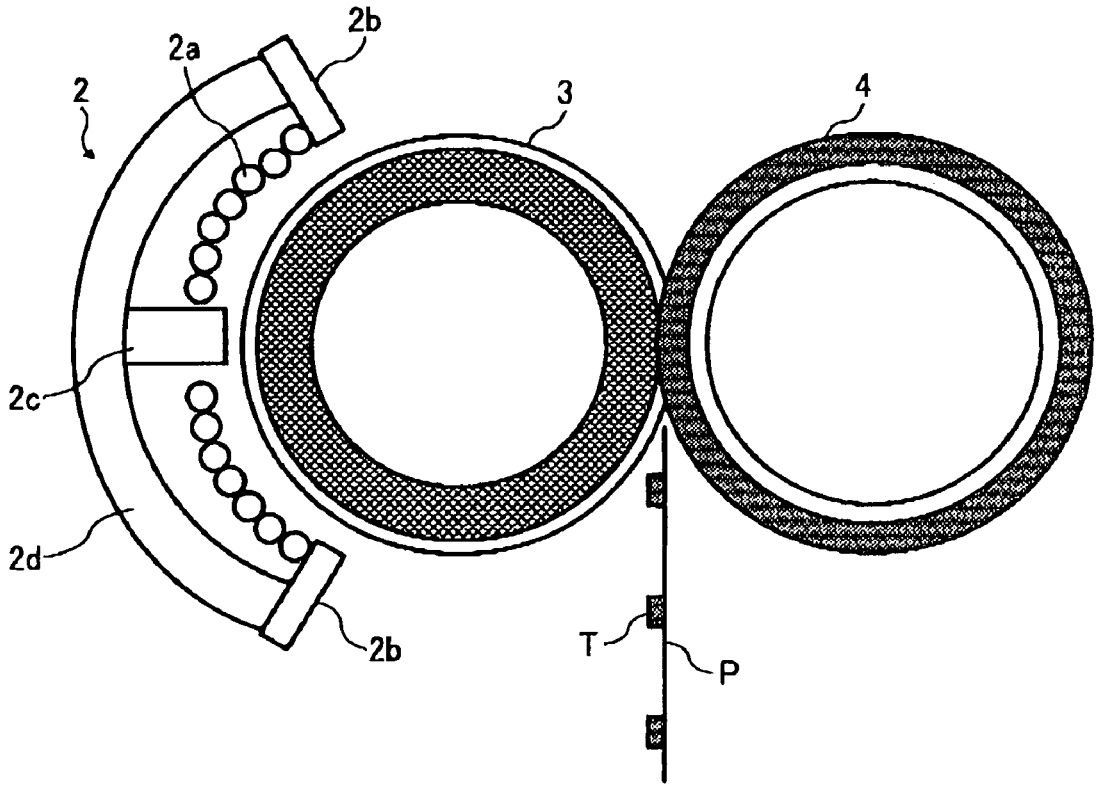
FIG. 2 is a cross-sectional view illustrating a fixing device to be used in the image forming apparatus of FIG. 1, according to an exemplary embodiment of the present invention.

Referring now to FIG. 2, there is provided a cross-sectional view illustrating schematically a structure of the fixing device using the rollers that may be included in the image forming apparatus 100 shown in FIG. 1.

As illustrated in FIG. 2, the fixing device includes a magnetic flux generator 2, a fixing roller 3, and a pressure roller 4. The letter symbol "P" refers to the recording medium, and "T" refers to the toner on the recording medium P. The fixing roller 3 serves as a heat generating member. The pressure roller 4 serves as a pressing member which presses the fixing roller 3 through the recording medium P bearing the toner image.

The magnetic flux generator 2 includes a coil 2*a*, side cores 2*b*, a center core 2*c*, and an arch core 2*d*. The coil 2*a* is disposed between the arch core 2*d* and the fixing roller 3.

In the fixing device shown in FIG. 2, the coil 2*a* of the magnetic flux generator 2 is driven by a high-frequency inverter, not shown, serving as an induction heating circuit, thereby generating a high-frequency magnetic field. Accordingly, the high-frequency magnetic field causes an eddy current to flow in the fixing roller 3 formed mostly of metal so that the temperature of the fixing roller 3 is increased.

Figure 3A:
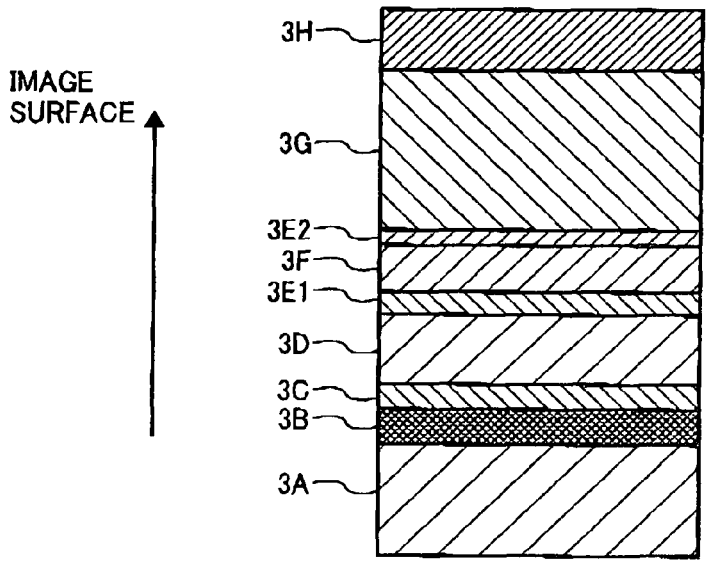
FIGS. 3A and 3B are cross-sectional views illustrating one portion of a fixing roller of the fixing device of FIG. 2, according to an exemplary embodiment of the present invention.
Figure 3B:
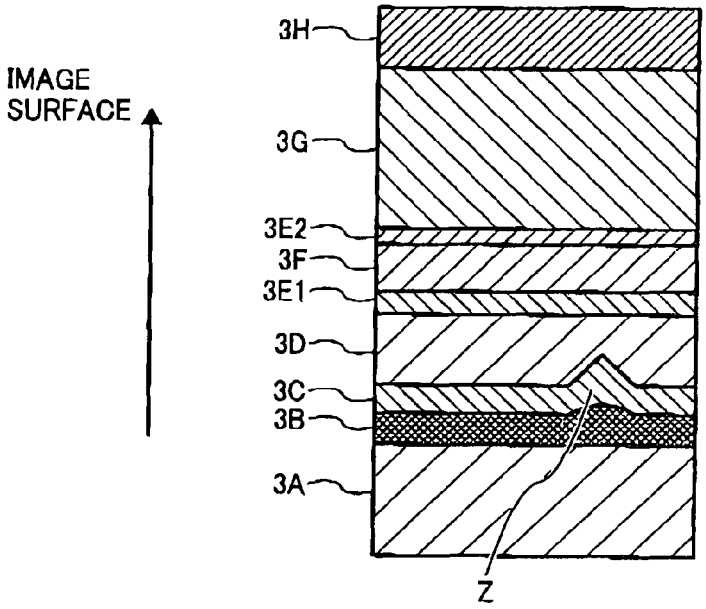

Referring now to FIGS. 3A and 3B, there are provided cross-sectional views illustrating a portion of the fixing roller 3. A diameter of the fixing roller 3 of FIGS. 3A and 3B is, for example, approximately 40 mm. As illustrated in FIG. 3A, an innermost fixing roller 3 includes a demagnetization layer (a metal core) 3A. The fixing roller 3 sequentially includes, in order from an inner side to an outer side in a direction toward the image bearing surface of the recording medium P as shown by an arrow, an elastic layer 3B for thermal insulation, a protective layer 3C, a magnetic shunt layer 3D, a first antioxidant layer 3E1, a heat generating layer 3F, a second antioxidant layer 3E2, an elastic layer 3G, and a release layer 3H which is a surface layer.

The demagnetization layer 3A may be formed of, for example, aluminum or an aluminum alloy. The elastic layer 3B may be formed of a relatively thick material, for example, a foam silicone rubber, a sponge, or the like, having a thickness, for example, of approximately 5 mm. The protective layer 3C may be formed of nickel (Ni) plating. The magnetic shunt layer 3D may be formed of known-art magnetic shunt alloys or any other suitable alloys. The magnetic shunt alloy herein refers to, for example, an alloy, magnetism of which disappears when the temperature rises, that is, when the temperature reaches a Curie point. For example, the Curie point of the Fe—Ne magnetic shunt alloy varies depending on a content of Ni. The heat generating layer 3F may be formed of copper plating. The elastic layer 3G may be formed of silicone rubber. The release layer 3H may be formed of PFA (tetrafluoroethylene-perfluoroalkylvinylether.) The thickness between the protective layer 3C and the surface of the release layer 3H is, for example, between approximately 200 micrometers and 250 micrometers.

However, it should be noted that the above-described embodiments are not limited to the structures (e.g. materials and thicknesses) described above.

The magnetic shunt layer 3D may include a magnetic member (e.g., a magnetic shunt alloy including iron and nickel) having a Curie point in a range of from approximately 100 degrees Celsius to 300 degrees Celsius. The shape of the magnetic shunt layer 3D is configured to be deformable when pressed by the pressure roller 4 so as to form a nip. The magnetic shunt layer 3D prevents the heat generating layer 3F and so forth from being overheated.

Furthermore, the shape of the nip on the fixing roller 3 side is recessed, and the nip can be easily formed. Accordingly, releasability of the recording medium P can be enhanced. It should be noted, however, that the layers, the shape of which may deform when pressed by the pressure roller 4, include the elastic layer 3B through the release layer 3H, except the demagnetization layer (metal core) 3A.

As described above, the shape of the layers from elastic layer 33 through the release layer 3H repeatedly deforms. Consequently, a crack may be easily formed in the magnetic shunt layer 3D, because during fabrication of the magnetic shunt layer 3D there is a possibility that the magnetic shunt layer 3D is damaged and thus has a crack having a sharp cross-sectional shape.

The crack formed in the magnetic shunt layer 3P emanates toward the release layer 3H with repeated deformation, and eventually reaches the heat generating layer 3F, which is a plating layer having the magnetism of copper, which is relatively brittle material.

Even if the crack propagates through the heat generating layer 3F, the elastic layer 3G formed of silicone rubber may prevent the crack from propagating further. However, the temperature distribution of the surface of the release layer 3H of the front layer varies irregularly where the crack propagates through the heat generating layer 3F.

As a result, the surface temperature may be uneven due to the crack. Such irregular temperature distribution adversely affects image transfer on the recording medium P. Consequently, an image defect may be generated.

In view of the above, according to the exemplary embodiments, the protective layer 3C formed of nickel plating is disposed at the inner side of the magnetic shunt layer 3D in a direction away from the image surface. Therefore, even if the crack having a sharp cross-sectional shape, as indicated by a letter symbol Z in FIG. 3, remains in the magnetic shunt layer 3D, when the protective layer 3C is provided in a manner shown in FIG. 3B, the crack edge becomes obtuse, thereby reducing, if not preventing entirely, further propagation of the crack.

It is preferable that the elastic layer 3B disposed at the inner side of the magnetic shunt layer 3D is formed of a material of lower thermal conductivity than that of the magnetic shunt layer 3D, to enhance thermal efficiency of the heat generating layer 3F.

As described above, the elastic layer 3B may be formed of the foam silicone rubber or the like. Alternatively, the elastic layer may be a layer of air or any other suitable heat-insulating layer.

The heat-insulating layer may or may not contain elastic material. When the heat-insulating layer contains elastic material, the pressure (a nip pressure) of the pressure roller 4 can be increased, thereby enhancing fixability.

It is preferable that the thickness of the elastic layer 3B be less than or equal to approximately 10 mm. Alternatively, an appropriate thickness may be obtained in accordance with a relational expression of intensity of the magnetic flux and so forth.

Alternatively, a rotary fixing member may be a roller, a sleeve, or a belt. When the magnetic shunt layer is formed independently of the heat generating layer, the magnetic shunt layer may be or may not be fixed to the heat generating layer. When the magnetic shunt layer is not fixed to the heat generating layer, the belt or the sleeve may include the heat generating layer, and the roller may include the magnetic shunt layer.

Alternatively, the fixing device may include a heating roller, a fixing belt wound around the heating roller, and a rotary fixing member for stretchedly supporting the fixing belt between the heating roller and the rotary fixing member. The heating roller serves as the heat generating roller.

Second Exemplary Embodiment

Figure 4:
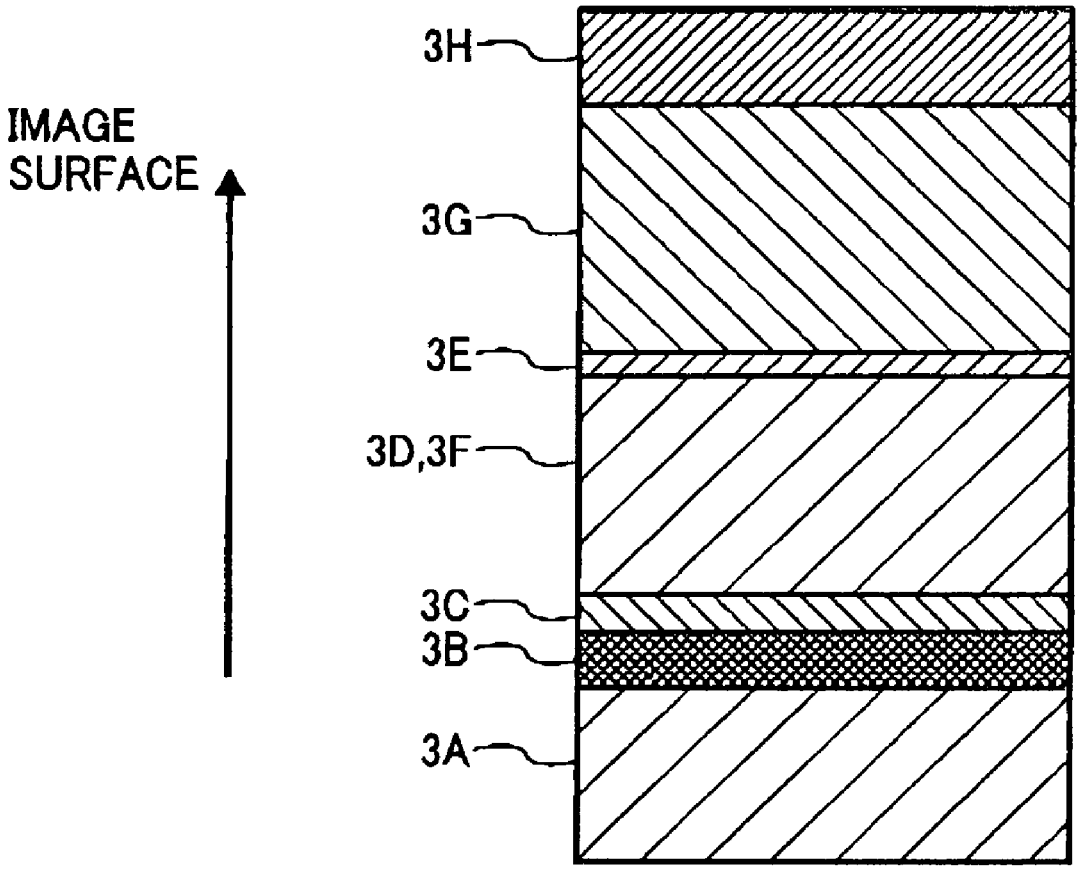
FIG. 4 is a cross-sectional view illustrating a portion of the fixing device according to another exemplary embodiment of the present invention.

Referring now to FIG. 4, there is provided a cross-sectional view illustrating a second exemplary embodiment. FIG. 4 illustrates one example of a layer integrally including the magnetic shunt layer 3D and the heat generating layer 3F.

The same reference numerals are given to constituent elements corresponding to the constituent elements shown in FIG. 3A, and redundant descriptions thereof will be omitted unless otherwise stated.

It should be noted that the antioxidant layer in FIG. 4 includes one layer, and is denoted as 3E in FIG. 4.

One or more embodiments of the present invention may be employed not only in the image forming apparatus described above, but also in a monochrome-image forming apparatus and an image forming apparatus for producing a color image.

Furthermore, elements and/or features of different exemplary embodiments may be combined with each other and/or substituted for each other within the scope of this disclosure and appended claims.

The number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

What is claimed is:

1. A fixing device to fix a toner image on a recording medium, comprising:

a magnetic flux generator configured to generate magnetic flux;

a heat generating roller including a heat generating layer configured to generate heat by the magnetic flux;

an elastic layer configured to thermally insulate a metal core;

a magnetic shunt layer configured to vary magnetism with temperature formed independently of the heat generating layer; and a protective layer provided at an inner surface of the magnetic shunt layer and an outer surface of the elastic layer, wherein the fixing device fixes an image onto the recording medium by the heat generated by the heat generating roller.

2. The fixing device according to claim 1, wherein the magnetic shunt layer is formed of an alloy including iron and nickel.

3. The fixing device according to claim 1, wherein the magnetic shunt layer includes a magnetic member having a Curie point in a range of from 100 degrees Celsius to 300 degrees Celsius.

4. The fixing device according to claim 1, wherein the protective layer is configured to smooth a cross-sectional shape of any crack in the magnetic shunt layer formed during fabrication.

5. The fixing device according to claim 1, wherein the protective layer is formed of nickel.

6. The fixing device according to claim 1, further comprising:

a pressure roller configured to come into contact with and press against the heat generating roller, wherein the heat generating roller is at least one of a roller, a sleeve, and a heat generating belt, and the image is fixed onto the recording medium when the recording medium passes between the heat generating roller and the pressure roller.

7. A fixing device to fix a toner image on a recording medium, comprising:

a magnetic flux generator configured to generate magnetic flux;

a heat generating roller including a heat generating layer configured to generate heat by the magnetic flux;

an elastic layer configured to thermally insulate a metal core;

a magnetic shunt layer configured to vary magnetism with temperature integrally provided with the heat generating layer; and a protective layer provided on an inner surface of the magnetic shunt layer and an outer surface of the elastic layer, wherein the fixing device fixes an image onto the recording medium by the heat generated by the heat generating roller.

8. The fixing device according to claim 7, wherein the magnetic shunt layer is formed of an alloy including iron and nickel.

9. The fixing device according to claim 7, wherein the magnetic shunt layer includes a magnetic member having a Curie point in a range of from 100 degrees Celsius to 300 degrees Celsius.

10. The fixing device according to claim 7, wherein the protective layer is configured to smooth a cross-sectional shape of any crack in the magnetic shunt layer formed during fabrication.

11. The fixing device according to claim 7, wherein the protective layer is formed of nickel.

12. The fixing device according to claim 7, further comprising:

a pressure roller configured to come into contact with and press against the heat generating roller, wherein the heat generating roller is at least one of a roller, a sleeve, and a heat generating belt, and the image is fixed onto the recording medium when the recording medium passes between the heat generating roller and the pressure roller.

13. An image forming apparatus, comprising:

a photoreceptor configured to bear a latent image on a surface thereof;

a charging device including a charging roller, configured to charge the photoreceptor;

a developing unit including a developing roller, configured to develop the latent image using toner; and a fixing device including a heat generating roller including a heat generating layer configured to generate heat caused by magnetic flux;

an elastic layer configured to thermally insulate a metal core;

a magnetic shunt layer configured to vary magnetism with temperature formed independently of the heat generating layer; and a protective layer formed at an inner surface of the magnetic shunt layer and an outer surface of the elastic layer, wherein the fixing device fixes an image onto a recording medium by the heat generated by the heat generating roller.

14. The fixing device according to claim 1, wherein the protective layer is in direct contact with the magnetic shunt layer and the elastic layer.

15. The fixing device according to claim 7, wherein the protective layer is in direct contact with the magnetic shunt layer and the elastic layer.

16. The image forming apparatus according to claim 13, wherein the protective layer is in direct contact with the magnetic shunt layer and the elastic layer.

* * * * *